US008719111B2

(12) United States Patent
Slater

(10) Patent No.: US 8,719,111 B2
(45) Date of Patent: May 6, 2014

(54) LOWERING RESERVE ONLINE AUCTION METHOD AND SYSTEM

(76) Inventor: Tyler A. Slater, Allen, TX (US)

( * ) Notice: Subject to any disclaimer, the term of this patent is extended or adjusted under 35 U.S.C. 154(b) by 372 days.

(21) Appl. No.: 13/159,251

(22) Filed: Jun. 13, 2011

(65) Prior Publication Data

US 2011/0307344 A1 Dec. 15, 2011

Related U.S. Application Data

(60) Provisional application No. 61/354,127, filed on Jun. 11, 2010.

(51) Int. Cl.
*G06Q 30/00* (2012.01)

(52) U.S. Cl.
USPC ..... 705/26.3

(58) Field of Classification Search
USPC ..... 705/26.1–27.2, 37
See application file for complete search history.

(56) References Cited

U.S. PATENT DOCUMENTS

2004/0193529 A1* 9/2004 Asher et al. ..... 705/37
2005/0216391 A1* 9/2005 Tews ..... 705/37
2012/0190435 A1* 7/2012 Muir ..... 463/25

OTHER PUBLICATIONS

"Auctoins and Bidding". R. Preston McAfee.Journal of Economic Literature. vol. XXV (Jun. 1987).*

* cited by examiner

*Primary Examiner* — William Allen
(74) *Attorney, Agent, or Firm* — Aaron P. Peacock; Gagnon, Peacock & Vereeke P.C.

(57) ABSTRACT

The present disclosure provides for a method and system for conducting an online lowering reserve auction including creating an auction by specifying an item for auctioning, a retail price of the item, a total number of options offered for sale during the auction, a sale price of each option, and a time duration for the auction, while the auction is open, selling an option, while the auction is open, receiving a bid for the item, if the total number of options offered for sale are purchased, designating as the winning bid the highest bid amount received, if the auction time for the item has expired and if the combination of the amount of the highest bid received and of the proceeds from the sale of the options are greater than the retail price of the item, designating as the winning bid the highest bid amount received.

12 Claims, 9 Drawing Sheets

LOWERING RESERVE ONLINE AUCTION METHOD AND SYSTEM

CROSS-REFERENCE TO RELATED APPLICATIONS

Applicant claims priority to U.S. Provisional Patent Application No. 61/354,127, filed Jun. 11, 2010, the disclosure of which is incorporated by reference herein in its entirety.

BACKGROUND

Figure 1:
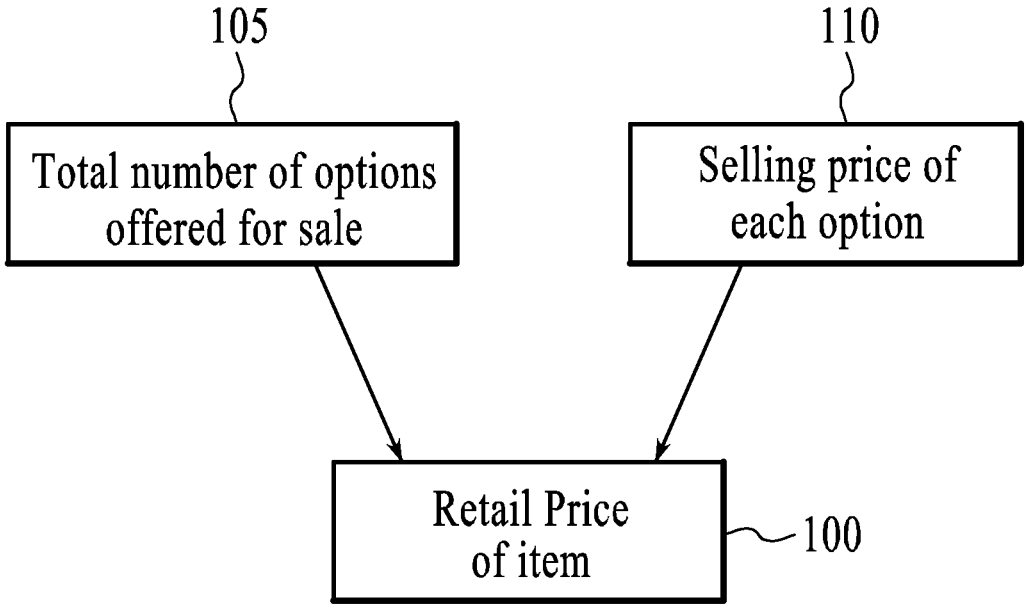
FIG. 1 is a block diagram that illustrates particular elements that comprise an embodiment of the present invention.

Because of the explosive growth in technology within the last few decades, individuals, organizations and businesses have become linked together inextricably through various means of electronic communications. Utilizing software applications, computers and similar type devices connected to differing and multiple networks have allowed individuals and entities to conduct activities with increased efficiency and effectiveness. Advancements in technology have enhanced a plethora of activities such as the transactional activities of buying and selling of goods and services. As the world community has increasingly become more intertwined via technology, world markets have become more integrated and transactional activities have become more interwoven.

Today, individuals, organizations and businesses purchase and sell a wide array of goods and services via the internet. An ever-increasing number of individuals, organizations and businesses are joining the on-line community, producing ever-increasing numbers of online sellers and buyers for goods and/or services. As a result of this growing online community of buyers and sellers, online auction websites have gained in popularity. While conventional online auctions methods and systems provide some benefits in comparison to the online fixed-priced market sales methods and systems, disadvantages and limitations do exist.

Among the disadvantages of conventional online auction methods and systems is a distortion in the selling price. Because online auction websites provide a forum for both buyers and sellers to electronically communicate and conduct auction transactions, many of the online auction website operators charge a fee to the sellers for the privilege and right to utilize the website's services and the website's forum. As a result of this fee, the sellers may decide to increase the initial asking price of the good or service in order to cover the cost of this fee. In the end, this fee may be passed to the buyers via a higher price for goods and/or services, thereby making auctioned goods and/or services more expensive.

The variable inability of a seller to obtain at least the retail price for a good or service is another of the many disadvantages of conventional online auction methods and systems. Once bidding commences at a predetermined starting bid, the seller may be obliged to sell the good or service at a price that is lower than the good or service's retail price. For example, a seller may wish to receive, at a minimum, the retail price of $10 for a product, setting the starting bid at $5. If only a single bid of $8 is proffered by a bidder before the close of the time designated for bidding, the seller may be obliged to accept the offer even though it is not equal to or greater than the seller's desired retail price of $10. Therefore utilizing conventional online auction systems and methods, sellers may not receive the desired retail price for the sale of their goods or services offered at auction.

What is needed is an innovative method and system that allows sellers in an online auction to obtain, at a minimum, a predetermined retail price for goods or services even if the auction's winning bid is less than the predetermined retail price. Moreover, what is needed is an innovative method and system that precludes distortion of the selling price all the while providing compensation to the online website operator for the use of the website's forum and services. Furthermore, what is needed is an innovative method and system that increases the efficiency and efficacy of online auctions for both buyers and sellers while eliminating many of the particular disadvantages of the conventional online auctions.

A lowering reserve online auction method and system, many of the embodiments which are disclosed herein, is a novel invention that meets the needs discussed in the above paragraph while also providing substantial advantages over the conventional online auction methods and systems. For example, an embodiment of the lowering reserve online auction method and system allows sellers to collect a pre-determined retail price for a particular good or service even if the winning bid by a customer is lower than that pre-determined retail price. This is accomplished by requiring each customer who desires to place a bid on the particular good or service (i.e., an item) to purchase an option before that customer is allowed to bid. Once the option is purchased, the customer can place a bid on the particular item being auctioned. Both the option's price and the number of options proffered for sale are set by either the seller and/or the website operator/administrator. For the benefit of use of the website's services to conduct a lower reserve online auction, the website operator/administrator receives all or a portion of the customer's winning bid amount.

As such, one advantage of the present invention is the merging of the online fixed-price sales methods with online auction methods, thereby allowing a seller to obtain the retail price amount for a good or service without requiring the customer who supplied the winning bid to pay the full retail price amount to the seller. Therefore, embodiments of the present invention combine the benefits of conventional auction methods and fixed-price sales methods. In the end, sellers are happy, because they obtained full retail price for the sale of an item; buyers are happy, because they obtained an item without having to pay full retail price for it.

When an individual or entity wishes to receive a fixed price for an item, the individual or entity will sell that item at a pre-determined fixed price. If a buyer does not agree to the seller's asking price, no sale is conducted. In an online fixed-price sale, the sale is only effectuated when a buyer agrees to the seller's asking price and agrees to provide the seller with payment sufficient to cover the asking price. While online fixed-price sales are popular, they do have certain drawbacks. For example, the seller's asking price may not accurately reflect the true value of the item. As such, the seller may set the asking-price of the item too high, thereby reducing the pool of potential buyers.

To combat certain drawbacks of online fixed-price sales, conventional online auctions can be utilized. Generally in a conventional online auction, a buyer and a seller agree to a mutually acceptable price for a particular item. Before the online auction begins, many times the seller has set an extremely low starting bid price at which bids for the auction are to begin. Then, each individual bidder places a bid that is higher than the previous bid placed. This process continues until the auction ends. At that time, the highest bidder wins the auction. Also in some instances, if a bidder is willing to pay the seller the retail price amount for the item during the auction, the auction suspends and that bidder instantly wins the auction. While conventional online auctions increase the pool of potential buyers and the accuracy of the valuation of an item, the seller may not receive the desired retail price for an item. As is evident, conventional online auctions have many drawbacks.

Embodiments of the present invention combine the advantages of both the online fixed-price market sales method and system and conventional online auction sales method and system while overcoming many of the disadvantages of each. Because sellers receive the pre-determined retail price for an item, the present invention performs similarly to a fixed-priced sale. On the other hand, a bidders bid as they would do ordinarily in an conventional online auction sale with the highest bidder winning the auction even if the winning bid is less than the retail price of the item, thereby allowing the present invention to function similarly to a conventional online auction. Because the present invention employs the advantages of a conventional online auction, more buyers will participate in the bidding process, thereby increasing the amount of bids on the good or service and thus causing the winning bid to more accurately reflect the true value of the item.

An embodiment of the present invention provides for an option to be purchased before a bid on an item can be submitted. If all the options are sold during the auction, the seller receives the proceeds of the sold options which equal the predetermined retail price of the item, and the website operator/administrator receives the proceeds of the payment of the winning bid amount. If, however, less than all the options are sold during the auction but the combination of the highest bid amount and the amount of the proceeds of the sale of the options exceed the pre-determined retail price of the item, then the seller receives the proceeds from the sale of those options and a portion of the highest bid which when aggregated together equal the pre-determined selling price of the item. Additionally, the website operator/administrator receives the remaining portion of the winning bid.

As is evident, all the main actors within the lowering reserve online auction method and system (i.e. seller, customer/buyer/winning bidder, and website operator/administrator) benefit. At the conclusion of a lowering reserve online auction, the seller can receive retail price (i.e. full value) for an item; the customer/buyer/winning bidder pays an amount that is lower than retail price for the purchase of an item; and the website operator/administrator can receive the customer's winning bid amount.

DETAILED DESCRIPTION

Turning to FIG. 1, a diagram is shown, depicting the unique elements that comprise the retail price of an item. The retail price of an item 100 is comprised of two elements: the total number of options offered for sale 105 and the selling price of each option 110. Mathematically, the relation can be stated as follows: retail price of an item=(total number of options)*(selling price of each option). Stated another way, the retail price of an item is equal to the total number of options offered for sale times the selling price of each option.

The total number of options offered for sale 105 and the selling price of each option 110 can be varied proportionally to maintain a constant retail price for an item. For example, if a seller wants to sell an item at a retail price of $100, 20 options can be sold at $5 apiece, or 10 options can be sold at $10 apiece, or even 100 options can be sold at $1 apiece. Therefore, a seller and/or website operator/administrator can determine and manage how many options are offered for sale 105 as well as the price of each option 110. This, in turn, will determine how many total bidders/customers can participate in the auction.

Before an auction can end with a winning customer, a sufficient number of options must be purchased. Because of this, the seller and/or website operator/administrator, may weigh several factors when determining the number of options to make available for sale 105 as well as the option price 110, such as the impact of the option price 110 on the potential bidding pool (i.e. a large option price 110 may shrink the number of bidders in the bidding pool while a small option price may enlarge the number of bidders in the pool). Therefore, persons of ordinary skill in this art will appreciate the flexibility that the present invention provides to sellers and/or website operators/administrators.

When the present invention produces a successful auction, the seller receives the pre-determined retail price for the item sold at auction. Specifically, the seller receives the product of the number of options sold and the price of each option, and in certain conditions, additionally may receive a portion of the winning bid amount. As such, in most instances, the seller is compensated for the item from the sale of the options and not from receipt of the winning bid. Therefore, in most instances, it is of little concern to the seller what the ultimate winning bid is, because the seller is compensated from the sale of the options.

It is only when all options have not been sold by the end of the auction's duration that the seller may be compensated partially from the winning bid amount. In mathematical terms, the seller will partially be compensated from the amount of the winning bid when {[(the number of options sold)*(the price of the option)]+(highest bid price)}>(pre-determined retail price of the item). Stated another way, the seller will be partial compensated from the amount of the winning bid when the summation the highest bid amount with the product of the number of options sold and option price is greater than the predetermined retail price of the item. If all the options have not been sold during the auction duration and the above mathematical test is met, then a portion of the winning bid amount along with the product of the number of options sold and option price will be remitted to the seller, so that the seller receives the pre-determined retail price. The remaining portion of the winning bid above the pre-determined retail price will be remitted to the website operator/administrator as payment for the use of the website's services.

For example, if a television having a retail price of $1000 is to be sold at auction utilizing an embodiment of the present invention, and it has been determined that 1,000 options will be offered for sale at $1 per option, and during the auction, all options are sold and a bid of $200 is the highest bid amount, then the seller will receive the $1,000 retail price of the television from the sale of the options (i.e. 1000 options times $1 per option), and the website operator/administrator will receive the winning bid amount of $200. If on the other hand, only 700 options are sold during the auction's duration and the highest bid at the end of the auction is $400, then the seller will still receive the $1,000 retail price because $700 from the option sales (i.e. 700 options multiplied by $1 per option) plus $300 from the winning bid amount (i.e. the portion of the winning bid that when combined with the proceeds from the sale of the options equals the pre-determined retail price of the item) equals $1000. The website operator/administrator will receive the remaining portion of the winning bid which in this example is $100 (i.e. $400 minus $300 equals $100).

The above example in which the highest bidder is $400 and all the options were not sold by the end of the auction still produced a successful auction. For this to be true, the amount received from the sale of the options plus the highest bid amount has to exceed the pre-determined retail price of the item—with any remaining portion of the winning bid being remitted to the website operator/administrator. If the amount received from the sale of the options plus the highest bid amount does not exceed the predetermined retail price of the item, then the auction is cancelled, and all customers that bid on the item are provided a refund in the amount of the option price each purchased. Thus using the example above, if 700 options are sold at $1 per option and at the end of the auction the highest bid amount is $200, then the auction is cancelled and all customers are refunded the $1 that each paid for the option.

Figure 2:
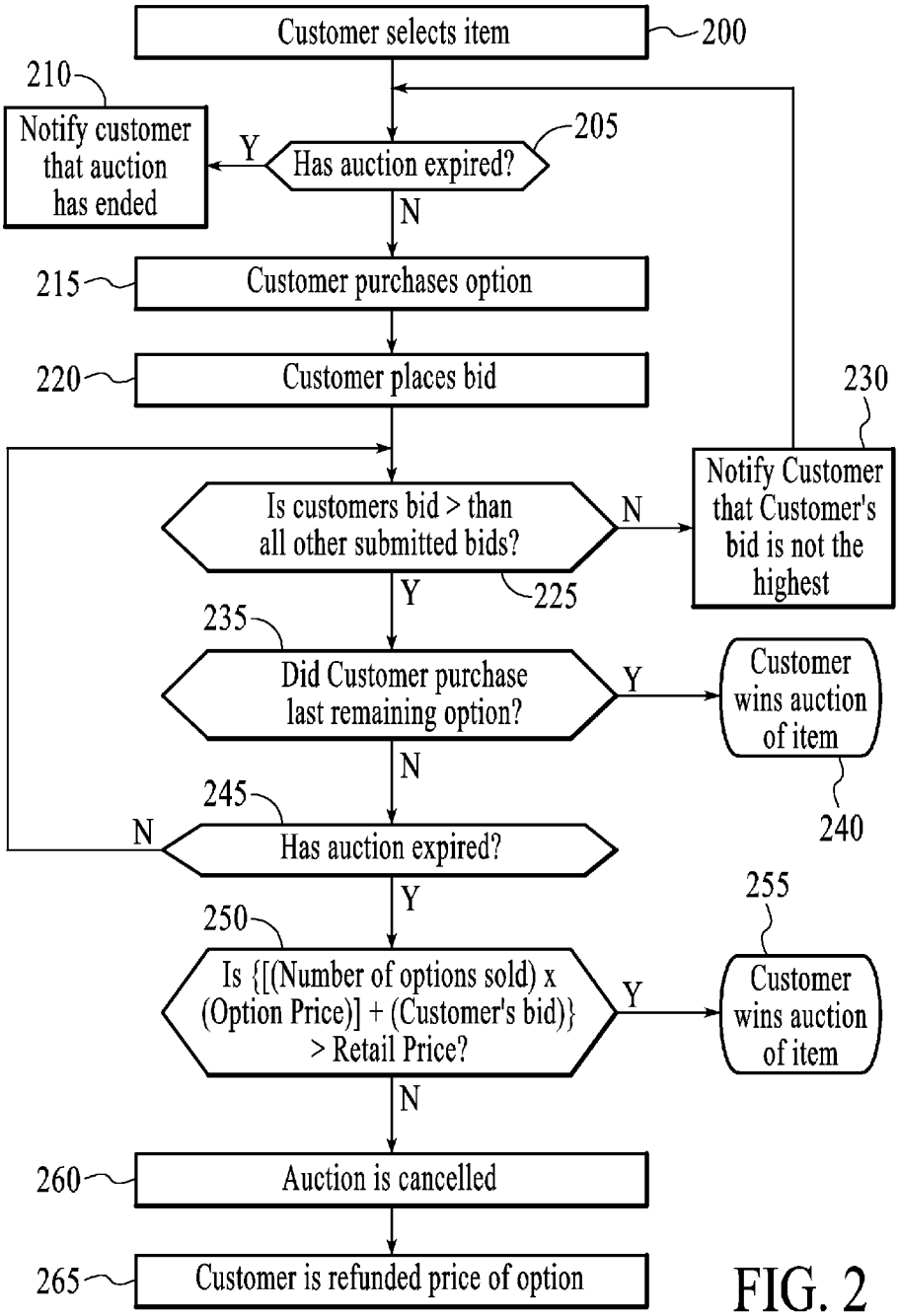
FIG. 2 is a flow diagram that illustrates an embodiment of the present invention.

FIG. 2 illustrates the process of an embodiment of the present invention. To begin, the customer (i.e., a prospective bidder or actual bidder) selects an item of interest 200. Generally, an auction has a beginning time and an end time, thus an auction's duration is finite. In the present invention, the auction's duration (i.e. its start time and end time) can be determined and set by the seller of an item and/or the website operator/administrator. Once the customer has selected an item of interest 200, a system component of the present invention determines whether the auction has expired for that particular item. If the auction for the item has expired 205, then the customer is notified that the auction for that particular item has ended 210. At that point, the customer may decide to browse other items that are being auctioned and select another item of interest. However, if the auction for that particular item has not expired 205 and if the predetermined total number of options for that item have not been sold, then the customer can purchase an option 215 at a predetermined price and place a bid on the item 220. In order to have the right to place a bid on an item 220, the customer must buy an option 215 that has been designated for that particular item. However, it should be noted that the purchase of an option 215 and the placing of a bid on an item 220 can be done at the same time such as when a customer provides payment (i.e. a credit card number) to purchase an option while also providing a bid amount to place on the item. In such an example, once the processing of the payment is complete, then the customer's bid is submitted.

Once the customer purchases an option 215 and places a bid 220, a determination is made as to whether the customer's bid is higher than all other submitted bids for the item being auctioned 225. If it is not, the customer is notified that the bid is not the highest bid for the item 230. Furthermore, the customer is given an opportunity to purchase another option for the item and place another bid, provided that the auction has not expired and the pre-determined total number of options have not sold out. Alternatively, the customer can browse other items for which to bid.

If, however, the customer does submit the highest bid 225, then a determination is made as to whether the customer purchased the last remaining option 235. If the customer has purchased the last remaining option 235, the customer has won the auction for that item 240. If, on the other hand, the customer has not purchased the last remaining option, the customer is notified that while it's bid is currently the highest submitted bid, the auction has not expired 245 and therefore there is still time for additional options to be purchased and additional bids to be submitted. At that point, the customer has a choice: the customer can purchase another option to submit another bid in order to place a higher bid and/or purchase the remaining option(s), take a wait-and-see approach in the hope that others will purchase options and provide bids that are lower than the customer's current bid, or allow the auction to expire in the hope that the amount of the customer's current bid will be high enough so that when it is combined with the sale price of all the options sold at the end of auction, the customer will have won the auction with its current bid.

If the auction has expired 245 and the customer has submitted the highest bid 225 but not all of the options have been purchased 235, then a determination has to be made as to whether the amount received from the sale of the options (i.e. the number of options sold multiplied by the option price) combined with the customer's current bid is greater than the pre-determined retail price for the item 250. If the customer's current bid amount combined with the amount received in the sale of the options is greater than the pre-determined retail price of the item, then the customer wins the auction of the item 255. If not, then the auction is cancelled 260, and all participating customers are refunded their respective costs in purchasing the option(s) 265. The refund can be a cash refund, a credit to the customer's credit card or bank card, or an in-store credit that can be applied to option(s) for other items, etc.

Figure 3:
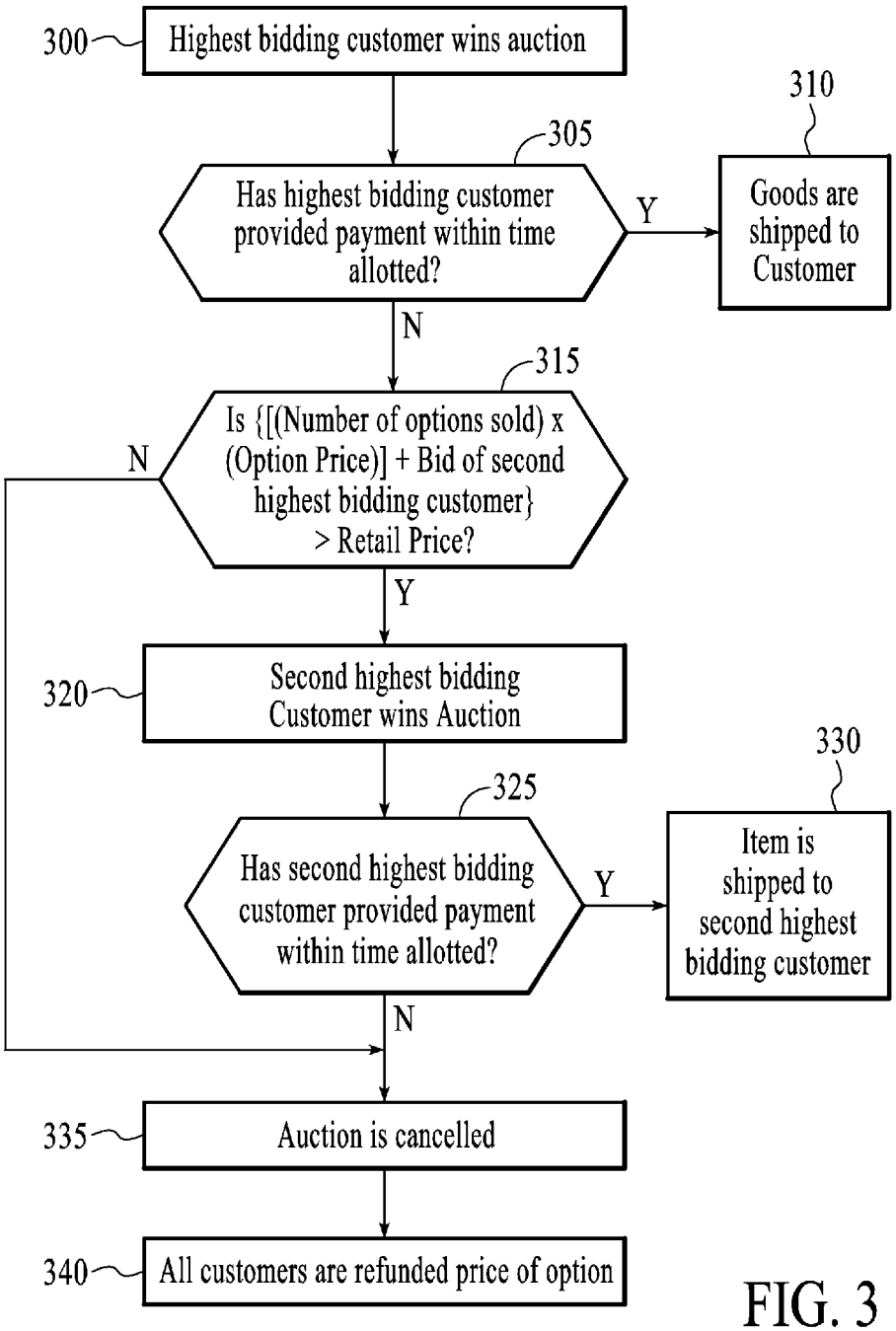
FIG. 3 is a flow diagram that illustrates an embodiment of the present invention.

Turning to FIG. 3, once a customer has placed the highest winning bid and has won the auction 300, the customer is provided a pre-determined amount of time to remit payment to cover the bid 305. If the customer provides payment within the allotted time 305, then the item that the customer won during the auction is shipped to the customer 310 using that customer's provided address. If, however, the customer does not provide payment in a pre-determined amount of time 305, then the second highest bid submitted during the auction is considered. It should be noted that if there are multiple equal bids submitted during the auction, then the bid submitted first in time is initially considered, and the bid submitted second in time is considered thereafter, and so on in that sequential order. Turning back to FIG. 3, in comparing the second highest bid, a determination is made as to whether the combination of the amount of the second highest bid and the amount of the sale of the options is greater than the pre-determined retail price of the item 315. Specifically, if the total amount of the sale of the options and the amount of the second highest bid is greater than the pre-determined retail price of the item 315, then the second highest bidding customer wins the auction 320. The customer who submitted the second highest bid is provided a pre-determined amount of time to remit payment to cover the cost of the bid. If the customer remits payment within the pre-determined amount of time 325, the item is shipped to the customer 330 using the address provided. If the customer doesn't remit payment in the pre-determined amount of time 324, the auction is cancelled 335 and all customers are refunded the price of the option(s) that each purchased 340. If, however, the amount of the sale of the options and the amount of the second highest bid is not greater than the pre-determined retail price of the item 315, the auction is cancelled 335 and all customers who participated in the auction and remitted payment for one or more options are refunded their respective costs for the purchase of the option (s) 340. The refund can be a cash refund, an in-store refund or other similar type of refund.

Figure 4:
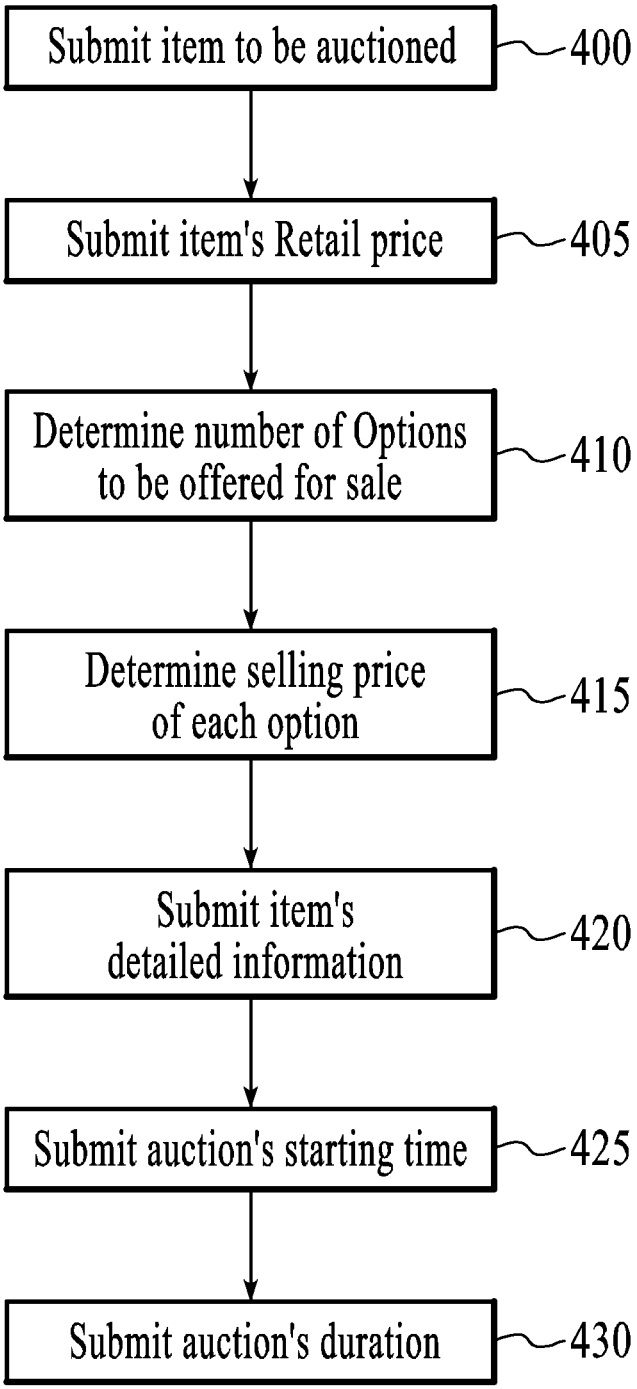
FIG. 4 is a block diagram that illustrates an embodiment of the present invention.

To participate in the online auction, embodiments of this present invention contemplate both customer(s) (i.e. prospective bidders, bidders, winners of bids, and ultimate buyers of the items auctioned), seller(s) (i.e. individuals or entities selling/auctioning goods or services to customers), and an electronic medium in which to link sellers with customers. An embodiment of the present invention contemplates a website that is operated by a website operator/administrator. As illustrated in FIG. 4, before an auction can commence, an item must be submitted 400. The submission can be performed by either a seller or a website operator/administrator. It should be noted that each step depicted in FIG. 4 can be accomplished by either the seller, a website operator/administrator or a combination of both. Additionally, it should be noted that the steps in FIG. 4 do not need to be performed in sequential order but can be performed in any order.

As mentioned previously, an item's retail price is calculated by determining the number of options offered for sale and the price of each option. Stated mathematically: retail price=(number of options to be sold)*(each option's selling price). Each component in the mathematical equation (i.e. the retail price, number of options to be sold, and each option's selling price) can be varied. Because of this relationship, only two components are required for submission as the third component can be computed. Also, as per mathematical rules, two components can be varied while the other component maintains its value. For example, 10=5*2=10*1. A retail price of $10 can be accomplished by selling a total of 5 options at a price of $2 per option, or by selling a total of 10 options at a price of $1 per option.

After determining the item to be auctioned 400, the item's retail price 405, the total number of options to be offered for sale 410 and the selling price of each option 415 must be determined, calculated and submitted. The seller and/or website operator/administrator may also submit detailed information about the item for the benefit of the customers. This information may be helpful to customers when they are decided whether or not to buy an option and make a bid for the item. For example, the detailed information could be the item's specifications, history, age, appearance, etc.

The auction of the item is performed only within a given amount of time. Therefore, the auction's duration must be provided. As such, the auction's starting time 425 and duration 430 must be determined and submitted. Alternatively, the auction's end time in place of the auction's duration 430 could be submitted as well. After the above information is determined and/or submitted, an online auction as contemplated by the present invention can commence.

Figure 5:
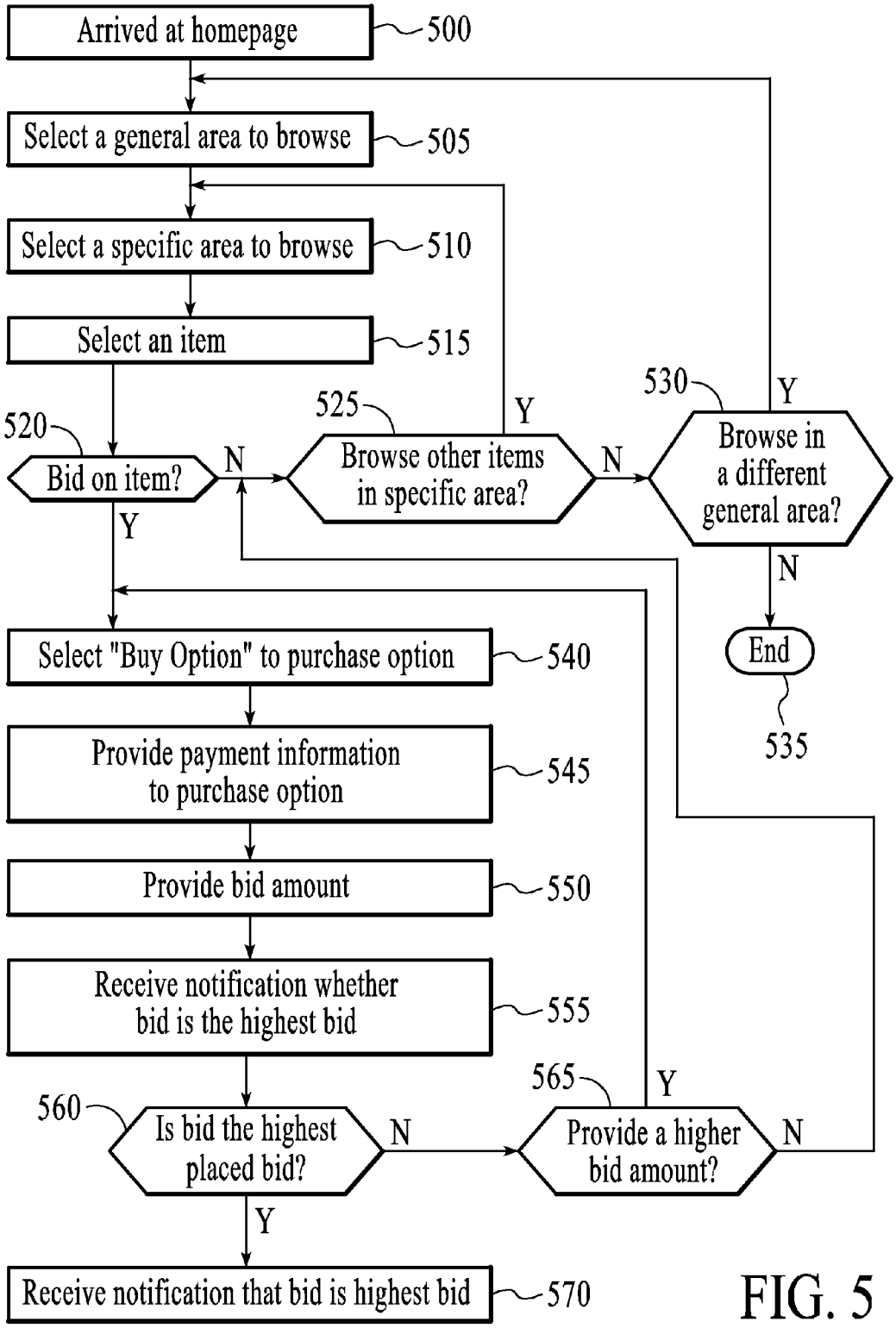
FIG. 5 is a flow diagram that illustrates an embodiment of the present invention from the perspective of the customer.

FIG. 5 illustrates an embodiment of the present invention from the perspective of a customer. A customer can arrive at the homepage of a website which is hosting an embodiment of the present invention 500. On the website, the browsing of items that are in the process of being auction is organized from general to more specific areas. For example, a general area may be classified as 'Electronics' with the more specific areas classified as 'TVs,' 'Computers,' 'Cameras,' etc. Therefore, once at the website, a customer may browse a more general classification 505 and then select a specific area within that general classification 510. The customer then either browses to a certain item and selects that item 515 or continues browsing for other items. After a customer has selected an item 515, the customer is given the opportunity to bid on that item (assuming the auction has not expired and the options have not sold out). The customer may be provided certain information such as the retail price of the item, the total number of options offered for sale, the total number of options still outstanding which have not been sold, and/or the current highest bid. At this point, the customer decides whether to make a bid on the item 520. If the customer does not wish to bid on the item, the customer may browse for other items in the specific area 525 or may browse items in another general area 530.

If the customer desires to bid on the item 520, the customer must purchase an option 540. To purchase an option, the customer must provide payment 545 such as but not limited to a credit card, electronic check, or in-store credit. At the time the customer purchases an option, the customer may also submit a bid amount 550. Once the payment for the option is processed and the bid amount it submitted, the customer is notified whether the submitted bid is currently the highest bid for the item 555. If the submitted bid is not the highest bid 560, the customer may submit a higher bid amount 565 by purchasing another option 540 and placing another bid. If, on the other hand, the customer's submitted bid is the current highest amount 560, the customer is notified of same 570. It should be noted that embodiments of this present invention contemplate notification in several different ways using several different technologies and technological platforms. Customer notification may be through the website conducting the auction such as when the website displays a page to the customer stating that the submitted bid is not currently the highest bid; it may be through email, text messaging (i.e. sms protocols), social media messaging, etc.

Figure 6:
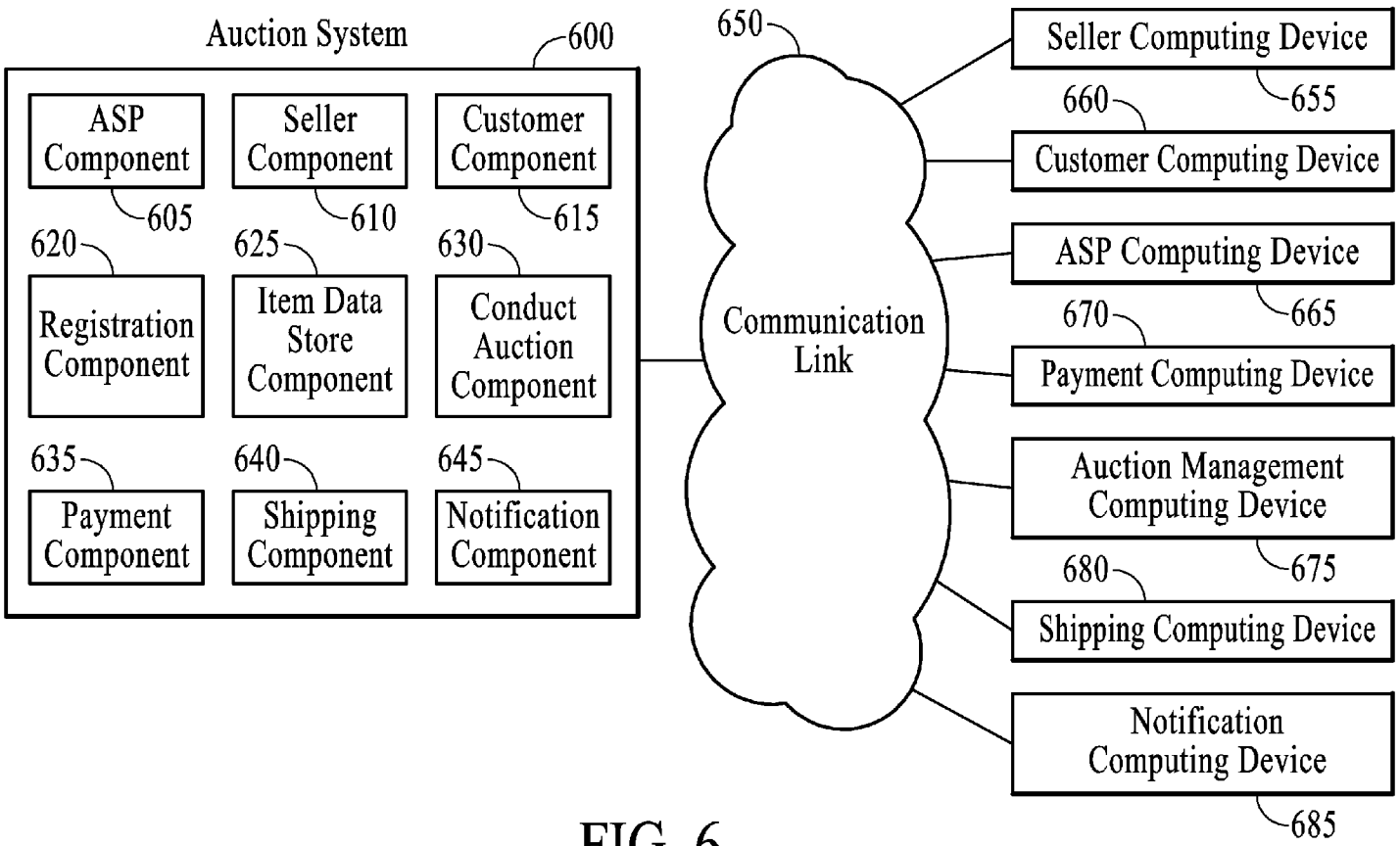
FIG. 6 is a block diagram that illustrates system components of the auction system in an embodiment of the present invention.

Turning to FIG. 6, a block diagram is depicted, illustrating the components of an embodiment of the lowering reserve online auction system. The auction system 600 is connected to various computing devices 655-685 via a communications link 650. The computing devices include a seller computing device 655, a customer computing device 660, an ASP (Application Service Provider) computing device 665, a payment computing device 670, an auction management computing device 675, a shipping computing device 680, and a notification computing device 685. Each computing device supports the functions needed by the seller, customer, website operator/administrator, and so on. The auction system 600 includes an ASP (Application Service Provider) component 605, a seller component 610, a customer component 615, a registration component 620, an item data store component 625, a conduct auction component 630, a payment component 635, a shipping component 640, and a notification component 645.

The ASP component 605 allows an application service provider and/or the website operator/administrator to define and manage particular administrative portions of the auction system 600. For example, the ASP component 605 can allow the website operator/administrator to create an auction for an item, manage the look and feel of the system, manage the database of various items in the auction system, and manage the performance of the auction by providing or altering the auction's duration, the item's pre-determined retail price, the total auctions offered for sale and each option's price. Additionally, the ASP component 605 allows for other type of administration functions as well.

The seller component 610 allows a seller to post items for auction in the auction system 600 by uploading various types of information about the item. For example, the seller may post one or more pictures of the item, detailed information about the item such as the item's specifications, the item's pre-determined retail price, the number of options offered for sale, and the price of each option.

The customer component 615 allows a customer to browse items and to place bids on items. For example, the customer may browse and locate an item, purchase an option, and then submit a bid on an item.

The registration component 620 allows the auction system 600 to register both sellers and customers by obtaining certain information from each such as but not limited to usernames, passwords, credit card numbers, checking account numbers, physical addresses, telephone numbers, names, etc.

The item data store component 625 allows the auction system to store and sort information regarding submitted items. For example, an item's picture and specification information may be stored and sorted.

The conduct auction component 630 allows the auction system 600 to execute and perform the auction for an item. Based on certain information such as an item's pre-determined retail price, total number of options offered for sale, outstanding options not sold, option price, beginning and end time of auction, and submitted bid amounts, the conduct auction component 630 allows the auction system 600 to determine whether a particular bid is the highest bid and whether that highest bid has won or lost the auction.

The payment component 635 allows the auction system 600 to receive payment information from either customers or sellers. For example, if a customer wishes to purchase an option or to cover a winning bid, the payment component 635 allows the auction system 600 to receive the necessary information from the customer to remit payment.

The shipping component 640 allows the auction system 600 to receive shipping information such as a seller's or a customer's physical address. For example, if a customer wins an auction and successfully remits payment to cover his winning bid, then the item is shipped to the customer.

The notification component 645 allows the auction system 600 to notify a customer and/or seller of important information regarding an auction. For example, once a customer purchases an option and submits a bid, the auction system 600 notifies the customer whether or not that submitted bid is the current highest bid and whether based on that bid the customer has won or lost the auction for that item. The notification can be sent to the customer via a website, electronic mail, and/or text message utilizing SMS protocol, or the like. Even if a customer submits the highest bid at a given point in time and is notified of such, ultimately the customer may not win the auction because a subsequent customer may submit a higher bid or because the amount received from the sale of the options when added to the highest bid amount may not be greater than the pre-determined retail price of the item. As such, the notification component 645 would allow the auction system 600 to notify the participating customers accordingly.

The computing devices 655-685 may be any type of computer device such as but not limited to a personal computer, server, minicomputer, mainframes, microcomputer, cellular phone, personal digital assistant, and smart phone. Furthermore, each computing device 655-685 supports the functions needed for the auction system 600. For example, the customer computing device 660 supports the functionality required for the customer to browse items, purchase options, place bids and provide payment. The seller computer device 655 supports the functionality required for the seller to post items for auction, and if necessary, provide information to the auction system 600 such as the pre-determined retail price, option price, etc. The ASP computing device 665 and the auction management computing device 675 supports the functionality required to host, control, and manage the auction system online The notification computing device 685 supports the functionality required to notify customers and/or sellers regarding important auction information such as whether a submitted bid is the highest bid and whether a customer has won or lost an auction. The payment computing device 670 and the shipping computing device 680 support the functionality required to receive and process payments from customers and to ship items to customers who have place and covered a winning bid, respectively.

The computing devices on which the auction system is implemented may include a central processing unit, memory, input devices (e.g., keyboard and pointing devices), output devices (e.g., display devices), and storage devices (e.g., disk drives). The memory and storage devices are computer-readable media that may be encoded with computer-executable instructions that implement the auction system. In addition, data structure and message structures may be stored or transmitted via a data transmission medium, such as a signal or communications link. Various communications links may be used, such as the internet, a local area network, a wide area network, or a point-to point dial-up network.

The auction system may be implemented in various operating environments. Various well-known computing systems, environments, and configurations that may be suitable for use include personal computers, server computers, hand-held or laptop devices, multiprocessor systems, microprocessor-based systems, programmable consumer electronics, network PCs, minicomputers, mainframe computers, distributed computer environments that include any of the above systems or devices, and the like.

The auction system may be described in the general context of computer-executable instructions, such as program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

Figure 7:
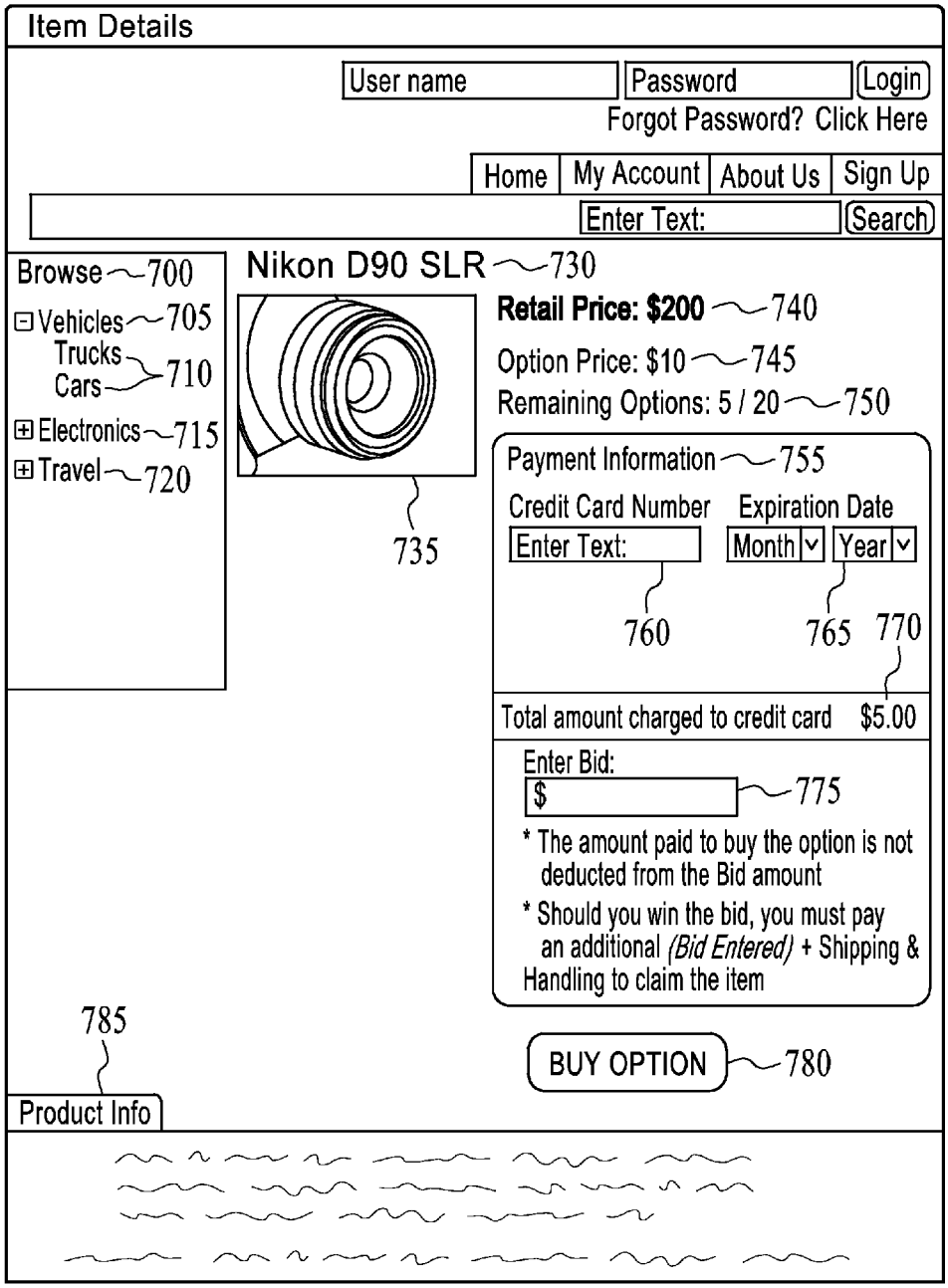
FIG. 7 is an example display page of a graphical user interface of an embodiment of the present invention wherein item and auction information are displayed to a customer and wherein the customer is provided an opportunity to purchase an option and place a bid on an item.

FIG. 7 depicts example of a particular screenshot of an embodiment of the present invention that a customer may see before the customer has purchased an option and placed a bid on an item. In the screenshot, the customer can select various areas of interest in which to browse 700. For example, the customer can select the general area of vehicles 705, electronics 715, or travel 720. If the customer selects vehicles 705, more narrow and specific areas emerge for which the customer to browse and select such as trucks 710. In the particular screenshot depicted in FIG. 7, the customer has selected electronics 715 and a picture of a camera is shown 735. Above the picture 735 is the title of the camera 730. At the bottom of the screenshot is additional information about the camera 785 such as the camera specifications, etc. The camera's pre-determined retail price is displayed 740 along with the price of an option 745, the current remaining options available for purchase and the total options offered for sale 750. If the customer wishes to place a bid, the customer must first purchase an option. An area of the screenshot provides for the receiving of payment information 755 wherein a customer can provide a credit card number 760 and the credit card's expiration date 765. The total amount that will be charge to the customer's credit card is shown 770 which in this example is $5. Also illustrated is an area for the customer to place a bid for the item 775. Once the customer enters the necessary information into the system (i.e. payment information and a bid amount), the customer can request to have the payment information processed and the bid amount submitted 780. It should be noted that the supplying of the bid amount and the payment information for the purchase of the option can be performed simultaneously as shown in FIG. 7.

Figure 8:
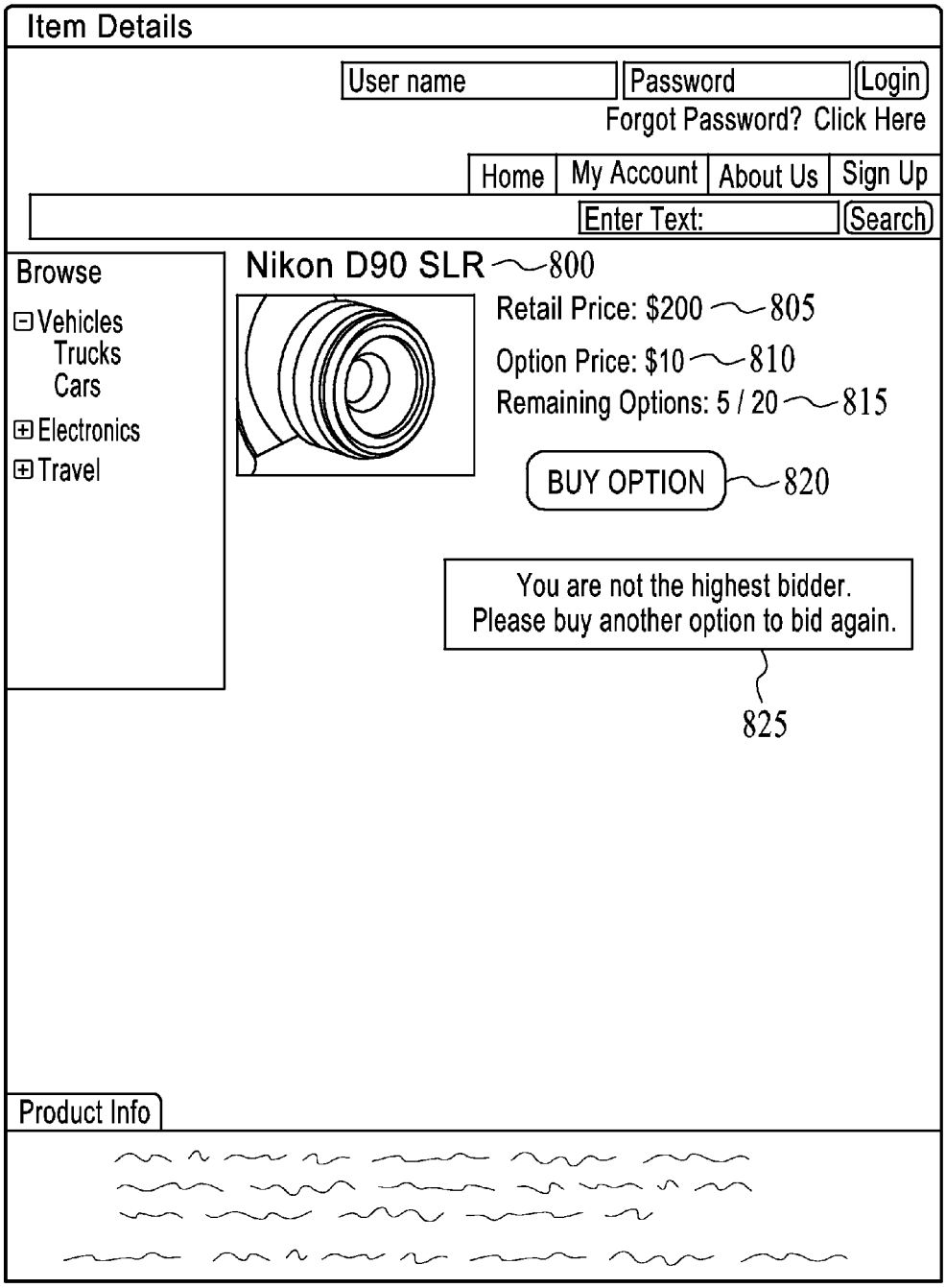
FIG. 8 is a an example display page of a graphical user interface of an embodiment of the present invention wherein item and auction information are displayed to a customer, notifying the customer that the customer's submitted bid is not the winning bid.

Once an option has been purchased and a bid submitted 780, a customer will be notified whether it has submitted the highest bid, has won the auction, or has not submitted the highest bid. FIG. 8 illustrates an example of a screenshot wherein the customer is notified that it has not submitted the highest bid. The screenshot of FIG. 8 also displays the item's name 800, the pre-determined retail price of the item 805, the item's option price 810, the remaining option available for purchase and the total number of options allocated for purchase for the item 815. The customer is given the opportunity to purchase another option and submit a new bid for the time. To do this, the customer would simply select the buy option button 820.

Figure 9:
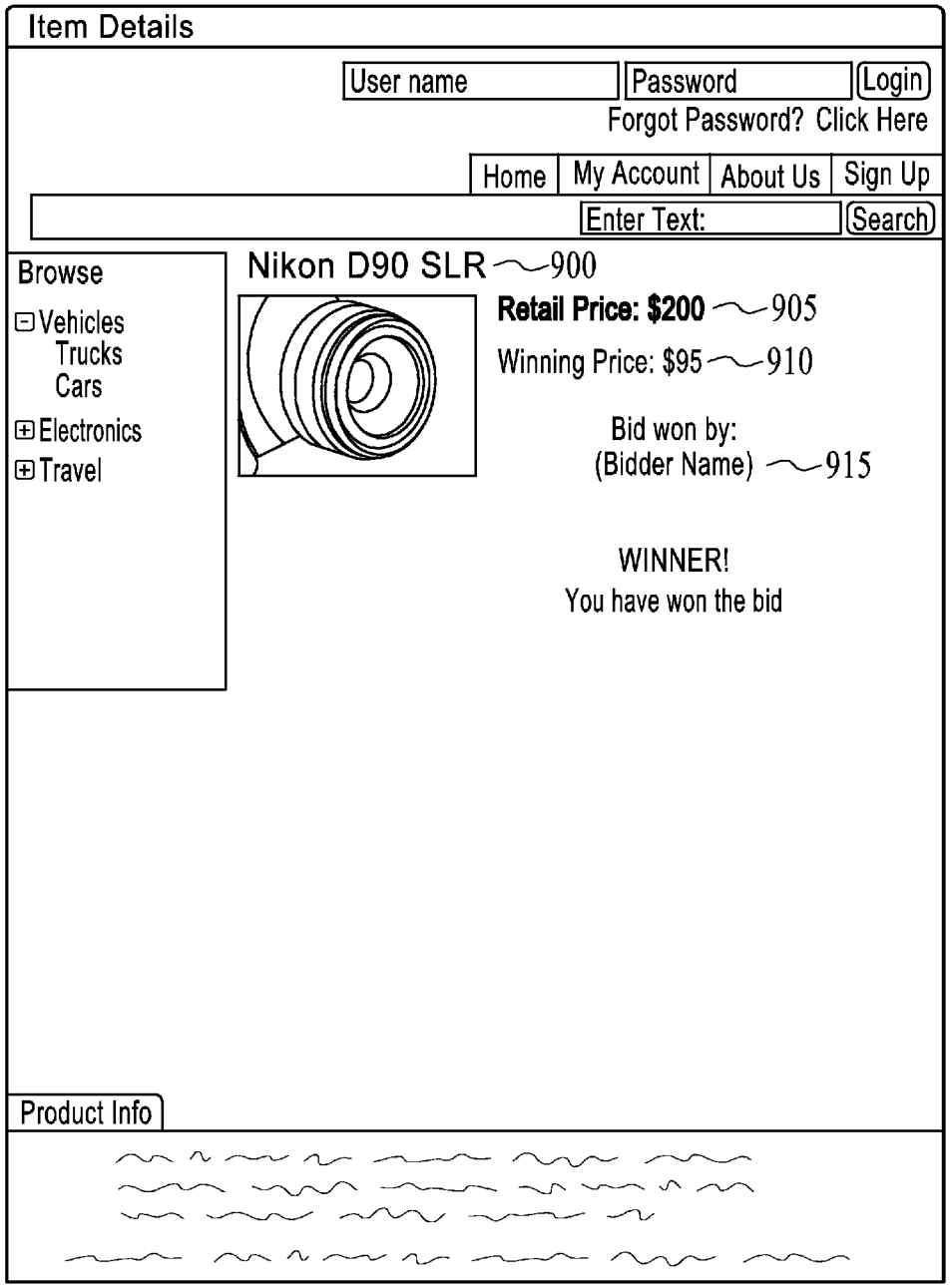
FIG. 9 is a an example display page of a graphical user interface of an embodiment of the present invention wherein item and auction information are displayed to a customer, notifying the customer that the customer's submitted bid is the winning bid.

If either all the options have been purchased, or if the highest bid amount in combination with the proceeds of the sold options exceed the pre-determined retail price of the item, then the highest bidding customer wins the auction. FIG. 9 illustrates an example of a screenshot that is notifying the highest bidding customer that it has won the auction. The screenshot of FIG. 9 also displays the item's name 900, the pre-determined retail price of the item 905, the winning bid of the item 910, and the winning bidder's name 915 or username.

Although the many embodiments of the invention have been illustrated in the accompanying Drawings and described in the foregoing Detailed Description, it should be understood that the present invention is not limited to the embodiments disclosed, but is capable of numerous rearrangements, modifications, and substitutions of parts and elements without departing from the spirit of the invention.

What is claimed is:

1. A method in a computer system for conducting a lowering reserve auction, the method comprising:

creating an auction by specifying an item for auctioning, a retail price of the item, a total number of options offered for sale during the auction of the item, a sale price of each option, and a time duration for the auction, wherein each option corresponds to a right to place a single bid;

while the auction is open, selling at least one option at the sale price of each option to at least one user, thereby allowing the at least one user to submit a bid for the item specified for auctioning;

while the auction is open, receiving a bid for the item from the at least one user;

determining, by a processor, if the total number of options offered for sale for the auction of the item are purchased;

responsive to determining that the total number of options offered for sale are purchased, causing, by a processor, the auction for the item to expire and designating as the winning bid the highest bid amount received;

determining, by a processor, if the auction time for the item has expired;

responsive to determining that the auction time has expired, determining, by a processor, if the combination of the amount of the highest bid received and of the proceeds from the sale of the options is greater than the retail price of the item;

responsive to determining that the combination of the amount of the highest bid received and of the proceeds from the sale of the options is greater than the retail price of the item, designating as the winning bid the highest bid amount received; and responsive to determining that the combination of the amount of the highest bid received and of the proceeds from the sale of the options are equal to or less than the retail price of the item:

cancelling the auction; and refunding, to the at least one user, the sale price for the at least one option sold to the at least one user.

2. The method of claim 1 wherein the retail price of an item is the product of the total number of options offered for sale during the auction of the item and of the sale price of each option.

3. The method of claim 2 wherein the selling of an option and the receipt of a bid occur simultaneously.

4. The method of claim 3 further comprising receiving payment for the designated wining bid within a predetermined amount of time.

5. The method of claim 4 further comprising providing the amount of the retail price of an item to the seller of the item, if a winning bid is designated and payment to cover the winning bid amount is received in a pre-determined amount of time.

6. The method of claim 5 further comprising providing the amount in excess of the retail price of an item to the operator of the computer system.

7. A system for conducting a lowering reserve auction, the system comprising:

an auction system server;

computer executable code, stored on the auction system server, the computer executable code configured to cause the auction system server to:

create an auction for an item specified for auctioning, the auction including a retail price of the item, a total number of options offered for sale during the auction of the item, a sale price of each option, and a time duration for the auction, wherein each option corresponds to a right to place a single bid;

sell, to at least one user, at least one option at the sale price of each option while the auction is open;

receive at least one bid for the item from the at least one user;

designate the highest bid amount received as the winning bid and cause the auction to expire when the total number of options offered for sale for the auction of the item are purchased;

designate the highest bid amount received as the winning bid when the auction time for the item has expired and the combination of the amount of the highest bid received and of the proceeds from the sale of the options is greater than the retail price of the item; and cancel the auction and refund, to the at least one user, the sale price for the at least one option sold to the at least one user when the auction time for the item has expired and the combination of the amount of the highest bid received and the proceeds from the sale of the option are equal to or less than the retail price of the item.

8. The system of claim 7 wherein the retail price of an item is the product of the total number of options offered for sale during the auction of the item and of the sale price of each option.

9. The system of claim 7 wherein the selling of an option and the receipt of a bid occur simultaneously.

10. The system of claim 7 wherein the computer executable code is configured to cause the auction system server to receive payment for the designated wining bid within a pre-determined amount of time.

11. The system of claim 7 wherein the computer executable code is configured to cause the auction system server to provide the amount of the retail price of an item to the seller of the item when a winning bid is designated and payment to cover the winning bid amount is received in a pre-determined amount of time.

12. The system of claim 11 wherein the computer executable code is configured to cause the auction system server to provide the amount in excess of the retail price of an item to the operator of the system.

* * * * *